US008727508B2

(12) United States Patent
Nystrom et al.

(10) Patent No.: US 8,727,508 B2
(45) Date of Patent: May 20, 2014

(54) BONDED SILICON STRUCTURE FOR HIGH DENSITY PRINT HEAD

(75) Inventors: Peter J Nystrom, Webster, NY (US); Bijoyraj Sahu, Gainesville, FL (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/293,235

(22) Filed: Nov. 10, 2011

(65) Prior Publication Data

US 2013/0120505 A1 May 16, 2013

(51) Int. Cl.
*B41J 2/16* (2006.01)
*B41J 2/045* (2006.01)

(52) U.S. Cl.
USPC ..... 347/71; 347/50

(58) Field of Classification Search
USPC ..... 347/50, 58, 68, 72
See application file for complete search history.

(56) References Cited

U.S. PATENT DOCUMENTS

| | | | | |
|---|---|---|---|---|
| 6,089,701 | A * | 7/2000 | Hashizume et al. | 347/70 |
| 6,325,488 | B1 * | 12/2001 | Beerling et al. | 347/42 |
| 6,443,179 | B1 * | 9/2002 | Benavides et al. | 137/454.2 |
| 6,616,270 | B1 * | 9/2003 | Miyata et al. | 347/68 |
| 7,200,907 | B2 * | 4/2007 | Takakuwa et al. | 29/25.35 |
| 7,217,999 | B1 * | 5/2007 | Honda | 257/712 |
| 7,226,151 | B2 * | 6/2007 | Murai | 347/71 |
| 7,422,314 | B2 * | 9/2008 | Yokouchi | 347/68 |
| 7,445,314 | B2 * | 11/2008 | Lee et al. | 347/45 |
| 7,448,731 | B2 * | 11/2008 | Murata | 347/68 |
| 7,495,373 | B2 * | 2/2009 | Sugahara | 310/328 |
| 7,527,356 | B2 * | 5/2009 | Sato | 347/50 |
| 7,540,968 | B2 * | 6/2009 | Nguyen et al. | 216/2 |
| 7,571,525 | B2 * | 8/2009 | Matsuzawa et al. | 29/25.35 |
| 7,681,989 | B2 * | 3/2010 | Lee et al. | 347/50 |
| 7,722,164 | B2 * | 5/2010 | Watanabe et al. | 347/70 |
| 7,905,580 | B2 * | 3/2011 | Xu et al. | 347/71 |
| 8,002,390 | B2 * | 8/2011 | Yagi et al. | 347/71 |
| 8,251,494 | B2 * | 8/2012 | Chen et al. | 347/50 |
| 8,322,830 | B2 * | 12/2012 | Takakuwa | 347/71 |
| 8,419,170 | B2 * | 4/2013 | Andrews et al. | 347/68 |
| 8,465,659 | B2 * | 6/2013 | Dolan et al. | 216/27 |
| 8,550,601 | B2 * | 10/2013 | Cellura et al. | 347/68 |
| 2002/0008743 | A1 * | 1/2002 | Murai | 347/71 |
| 2003/0025768 | A1 * | 2/2003 | Koike et al. | 347/68 |
| 2005/0052504 | A1 * | 3/2005 | Murai | 347/71 |
| 2006/0164466 | A1 * | 7/2006 | Mizuno et al. | 347/58 |

(Continued)

FOREIGN PATENT DOCUMENTS

| | | | |
|---|---|---|---|
| JP | 2010093810 | A * | 4/2010 |
| WO | WO 2011129072 | A1 * | 10/2011 |
| WO | WO 2011129702 | A1 * | 10/2011 |

*Primary Examiner* — Matthew Luu
*Assistant Examiner* — Patrick King
(74) *Attorney, Agent, or Firm* — MH2 Technology Law Group LLP

(57) ABSTRACT

A print head including a jet stack can be formed using semiconductor device manufacturing techniques. A blanket metal layer, a blanket piezoelectric element layer, and a blanket conductive layer can be formed over a semiconductor substrate such as a semiconductor wafer or wafer section. The piezoelectric element layer and the blanket conductive layer can be patterned to provide a plurality of transducer piezoelectric elements and top electrodes respectively, while the metal layer forms a bottom electrode for the plurality of transducers. Subsequently, the semiconductor substrate can be patterned to form a body plate for the print head jet stack. Forming a print head jet stack using semiconductor device manufacturing techniques can provide a high resolution device with small feature sizes.

13 Claims, 7 Drawing Sheets

(56) References Cited

U.S. PATENT DOCUMENTS

| | | | | |
|---|---|---|---|---|
| 2006/0209139 | A1* | 9/2006 | Murata | 347/71 |
| 2006/0268074 | A1* | 11/2006 | Hori | 347/68 |
| 2006/0290747 | A1* | 12/2006 | Shimada et al. | 347/68 |
| 2007/0171260 | A1* | 7/2007 | Lee et al. | 347/71 |
| 2009/0207214 | A1* | 8/2009 | Yagi et al. | 347/71 |
| 2009/0289999 | A1* | 11/2009 | Takahashi et al. | 347/71 |
| 2010/0265301 | A1* | 10/2010 | Takakuwa | 347/71 |
| 2011/0193916 | A1* | 8/2011 | Hirai et al. | 347/71 |
| 2012/0038714 | A1* | 2/2012 | Harigai et al. | 347/71 |
| 2012/0242756 | A1* | 9/2012 | Nystrom et al. | 347/70 |
| 2012/0256990 | A1* | 10/2012 | Gerner et al. | 347/70 |

* cited by examiner

BONDED SILICON STRUCTURE FOR HIGH DENSITY PRINT HEAD

FIELD OF THE EMBODIMENTS

The present teachings relate to the field of ink jet printing devices and, more particularly, to a high density piezoelectric ink jet print head and a printer including a high density piezoelectric ink jet print head.

BACKGROUND OF THE EMBODIMENTS

Drop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored as they can use a wider variety of inks and eliminate problems with kogation.

Piezoelectric ink jet print heads typically include a flexible diaphragm manufactured from, for example, stainless steel. Piezoelectric ink jet print heads can also include an array of individual piezoelectric transducers (i.e., PZT or actuator) attached to the diaphragm. Other structures can include one or more laser-patterned dielectric standoff layers and a flexible printed circuit (flex circuit) or printed circuit board (PCB) electrically coupled with each transducer. A print head can further include a body plate, an outlet plate, and an aperture plate, each of which can be manufactured from stainless steel. Additionally, a print head can include various adhesive layers, for example laser-patterned adhesive layers, to hold each structure together and to provide an ink pathway from an ink reservoir, through the print head, and out a plurality of nozzles in the aperture plate.

During use of a piezoelectric print head, a voltage is applied to a piezoelectric transducer, typically through electrical connection with a flex circuit electrode electrically coupled to a voltage source, which causes the piezoelectric transducer to bend or deflect, resulting in a flexing of the diaphragm. Diaphragm flexing by the piezoelectric transducer expels a quantity of ink from a chamber through a particular nozzle (i.e., one or more openings) in the aperture plate. The flexing further draws ink into the chamber from a main ink reservoir through an opening to replace the expelled ink.

As resolution and density of the print heads increase, the area available to provide electrical interconnects decreases. Routing of other functions within the head, such as ink feed structures and electrical interconnects, compete for this reduced space and place restrictions on the types of materials used. For example, current technology for use with a 600 dots-per-inch (DPI) print head can include parallel electrical traces on the flex circuit with each trace electrically connected to a pad (i.e., electrode) of the pad array (i.e., electrode array) of the flex circuit. The parallel traces can have a 38 micrometer (μm) pitch and a 16 μm trace width, thereby leaving a 22 μm space between each trace. As print head densities increase, current flex circuit design practices will require formation of traces and pads having tighter tolerances and smaller feature sizes.

Methods for manufacturing a print head which can have improved reliability, yields, and scalability, and the resulting print head, would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

An embodiment of the present teachings can include method for forming a print head jet stack having a plurality of transducers, the method including forming a metal layer over a semiconductor substrate, forming a piezoelectric layer over the metal layer, and forming a conductive layer over the piezoelectric layer. The conductive layer can be etched to form a plurality of transducer top electrodes for the plurality of transducers. Further, the piezoelectric layer can be etched to form a plurality of piezoelectric elements for the plurality of transducers, and the semiconductor substrate can be etched to form a body plate from the semiconductor substrate for the print head jet stack.

In another embodiment, a print head jet stack can include a plurality of transducers, wherein the print head jet stack includes a semiconductor substrate body plate, a diaphragm overlying the semiconductor substrate body plate, a patterned piezoelectric layer overlying the diaphragm, and a patterned conductive layer overlying the patterned piezoelectric layer. In an embodiment, the diaphragm includes a conductive bottom electrode of the plurality of transducers, the patterned piezoelectric layer includes a plurality of piezoelectric elements for the plurality of transducers, and the patterned conductive layer includes a plurality of top electrodes for the plurality of transducers.

In another embodiment of the present teachings, a printer can include a print head having a print head jet stack. The print head jet stack can include a plurality of transducers, a semiconductor substrate body plate, a diaphragm overlying the semiconductor substrate body plate, a patterned piezoelectric layer overlying the diaphragm, and a patterned conductive layer overlying the patterned piezoelectric layer. In an embodiment, the diaphragm includes a conductive bottom electrode of the plurality of transducers, the patterned piezoelectric layer includes a plurality of piezoelectric elements for the plurality of transducers, and the patterned conductive layer includes a plurality of top electrodes for the plurality of transducers. The printer can further include a printer housing which encloses the print head.

BRIEF DESCRIPTION OF THE DRAWINGS

The accompanying drawings, which are incorporated in and constitute a part of this specification, illustrate embodiments of the present teachings and together with, the description, serve to explain the principles of the disclosure. In the figures.

It should be noted that some details of the FIGS. have been simplified and are drawn to facilitate understanding of the present teachings rather than to maintain strict structural accuracy, detail, and scale.

DESCRIPTION OF THE EMBODIMENTS

Reference will now be made in detail to the exemplary embodiments of the present teachings, examples of which are illustrated in the accompanying drawings. Wherever possible, the same reference numbers will be used throughout the drawings to refer to the same or like parts.

As used herein unless otherwise specified, the word "printer" encompasses any apparatus that performs a print outputting function for any purpose, such as a digital copier, a bookmaking machine, a facsimile machine, a multi-function machine, a plotter, etc.

Designs of piezoelectric print heads are known to have various failure modes. For example, multiple materials and laminations can be prone to separation or delamination which can result in ink leaking and corroding electrical connections to the piezoelectric transducers. Further, contamination can block the nozzles and result in reduced print quality. Additionally, misalignment of patterned adhesive layers and standoff layers can restrict the flow of ink through ink pathways. Over the lifetime of the print head, reliability can be negatively impacted by faults from temperature cycling and other induced stresses.

In addition, the space to run individual traces (i.e., leads) to each piezoelectric transducer on a flex circuit or PCB is limited. As the number of piezoelectric transducers increases to provide higher resolution print heads, it becomes more difficult to provide an increased number of traces in the space available.

An embodiment of the present teachings can include the formation of various mechanical and electrical print head structures using semiconductor device (microelectronic) fabrication techniques such as semiconductor wafer assembly fabrication techniques. For example, as described in detail below, a conventional stainless steel body plate can be replaced with a structure fabricated from an etched semiconductor substrate. A conventional stainless steel diaphragm can be replaced with a metal layer which is formed to overlie the semiconductor substrate. Various electrical pads and traces which are conventionally formed using a flex circuit or PCB can be provided using a process which includes semiconductor device metallization techniques. In general, the use of semiconductor device fabrication techniques such as optical photolithography, silicon, metal and dielectric etching, chemical vapor deposition (CVD), sputtering, etc., can provide a high density print head and a printer using the high density print head. Delamination of these materials formed using semiconductor device processing techniques may be less likely than conventional structures.

Figure 1:
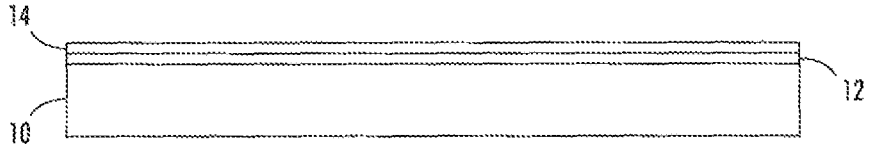
FIGS. 1-11 are cross sections depicting in-process structures for an ink jet print head according to an embodiment of the present teachings.

An embodiment of the present teachings is depicted in FIGS. 1-11. FIG. 1 depicts a semiconductor substrate 10 which can be a semiconductor wafer such as a silicon wafer, a gallium wafer, etc. In other embodiments, the semiconductor substrate 10 can be an epitaxial silicon layer, quartz, ceramic, glass, and composites of these materials. As used herein, the term "semiconductor substrate" will include any of these materials unless otherwise specified. It will be understood that the semiconductor substrate 10 can also be a semiconductor wafer section or other materials which are of a of suitable size. The materials can be diced from a semiconductor wafer, for example, or formed to have a suitable size without the need for dicing. The semiconductor substrate 10 can include various other structures, such as conductive structures, dielectric structures, or doped regions which are not depicted for simplicity.

At this point in the process, the semiconductor substrate 10 can have a thickness of between about 200 μm and about 600 μm, depending on the particular design. In an embodiment, the wafer thickness can be between about 500 μm and about 600 μm. In another embodiment, the wafer thickness can be between about 200 μm and about 300 μm, for example about 250 μm, or another suitable thickness. The semiconductor layer will function as at least a portion of the body plate of the completed print head jet stack as described below.

As depicted in FIG. 1, a blanket dielectric etch stop layer 12 such as a silicon dioxide or silicon nitride is formed over the semiconductor substrate using known techniques, for example material deposition or silicon dioxide growth by oxidizing the silicon wafer. An etch stop layer 12 can be grown on a silicon wafer or deposited on the semiconductor substrate 10 to a thickness of between about 1 μm and about 10 μm, or another suitable thickness. In another embodiment, structure 12 can represent a doped region in the semiconductor substrate 10 which provides an etch stop layer, for example using a boron implant, such that the etch stop layer does not add to the thickness of the structure.

Subsequently, a blanket metal layer 14 is formed over the surface of the semiconductor substrate 10 and on the etch stop layer 12 such that the etch stop layer 12 is interposed between the blanket metal layer 14 and the semiconductor substrate 10. The blanket metal layer 14 can be formed using, for example, sputtering or chemical vapor deposition (CVD) to a thickness of between about 5 μm to about 10 μm, or from about 7 μm to about 8 μm, or another suitable thickness. In an embodiment, the metal layer 14 can include nickel, chromium, or titanium, alloys and/or combinations of these metals, or other suitable metals. In another embodiment, metal layer 14 can include multiple layers of different metals. The metal layer 14 can include other layers such as one or more adhesion layers which physically contact the etch stop layer 12 to ensure adhesion between the metal layer 14 and the etch stop 12, or formed on top of a predominant core metal layer to ensure adhesion to subsequent layers. The metal layer 14 can function as at least a portion of the diaphragm of the completed print head jet stack, as well as the bottom electrode (i.e., bottom plate or bottom capacitor plate) of each piezoelectric transducer as described below. Either or both of the metal layer 14 and the etch stop layer 12 can be patterned at this point, or at other processing stages, to form ink ports for the flow of ink through the diaphragm of the completed print head. The processing stage at which ink ports are formed through the diaphragm will depend on the particular print head design.

Figure 2:
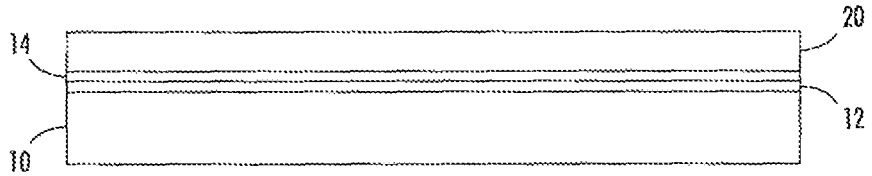

After forming a structure similar to that depicted in FIG. 1, a piezoelectric layer 20 can be formed over the metal layer 14 as depicted in FIG. 2. The piezoelectric layer 20 can be, for example, a monolithic layer of lead-zirconate-titanate which is bonded to the metal layer 14. In another embodiment, piezoelectric layer 20 can be a film which is chemically deposited using, for example, a sol-gel process. In yet another embodiment, piezoelectric layer 20 can be mechanically deposited using, for example, a sputtering process. Other suitable processing techniques can also be used. In an embodiment, the piezoelectric layer 20 can be formed to a thickness of between about 5 μm and about 50 μm, or another suitable thickness. The piezoelectric layer 20 will function as the piezoelectric layer of the transducer as described below.

Figure 3:
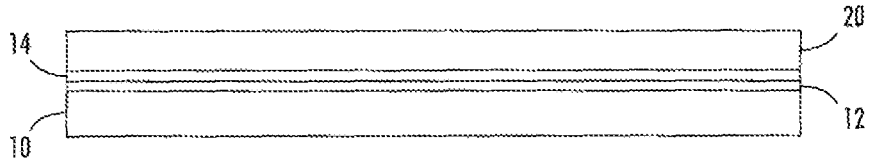

Subsequently, the thickness of the semiconductor substrate 10 can be reduced, for example using an etchback, grinding, or polishing process to result in the structure of FIG. 3. The reduction in thickness of the semiconductor substrate 10 results in a structure which has a thickness suitable for use as the jet stack body plate. In an embodiment, the thickness of the semiconductor substrate 10 can be decreased to between about 50 μm and about 125 μm, or between about 75 μm and about 100 μm. Decreasing the thickness of the semiconductor substrate after initial fabrication of the print head can reduce damage to a brittle wafer. The final thickness of the wafer can also be established either earlier or later in the manufacturing process of the print head.

Figure 4:
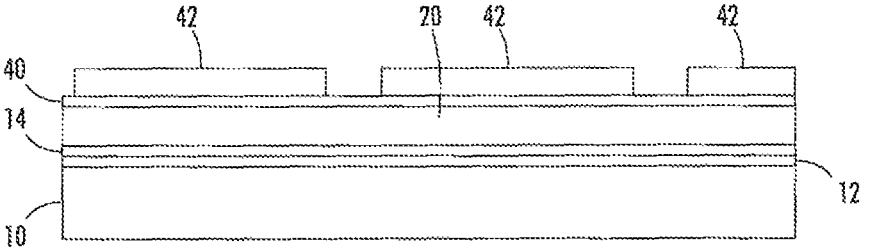

Subsequently, a conductive layer 40 is formed over the piezoelectric layer 20 as depicted in FIG. 4. The conductive layer 40 can include one or more layers of nickel, gold, aluminum, one or more alloys, or other suitable materials. In an embodiment, an adhesion layer (not individually depicted for simplicity) can be formed on the piezoelectric layer 20 to enhance attachment of the conductive layer 40 to the piezoelectric layer 20. In an embodiment, conductive layer 40 can be between about 0.05 μm and about 2.0 μm thick, and can be formed using sputtering, CVD, or another suitable process. The conductive layer 40 can function as the top electrodes (i.e., top plate or top capacitor plate) of the each transducer of the piezoelectric transducer array in the completed jet stack. FIG. 4 further depicts a patterned mask layer 42 on the conductive layer 40, for example a patterned photoresist mask which can be formed using optical photolithography.

Figure 5:
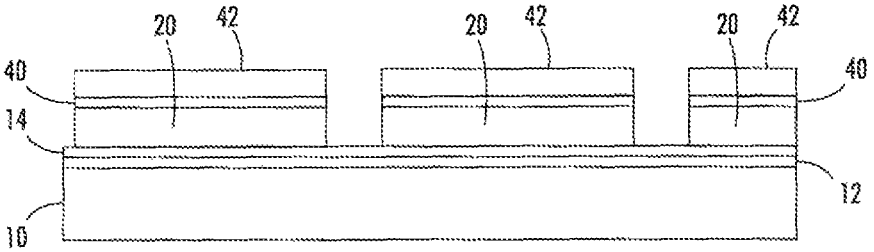

After forming a structure similar to that depicted in FIG. 4, an etch can be performed to remove exposed portions of the conductive layer 40 and the piezoelectric layer 20, and stopping on the metal layer 14 to form the FIG. 5 structure. In an embodiment, a first etch can remove the conductive layer 40 and a different second etch can remove the piezoelectric layer 20 selective to the conductive layer 40 and the metal layer 14. In another embodiment, a single etch can be performed to remove exposed portions of the conductive layer 40 and the piezoelectric layer 20, and which stops on the metal layer 14. Stopping on metal layer 14 can be performed either through the use of a timed etch or through the use of an etch chemistry which removes conductive layer 40 and piezoelectric layer 20 selective to metal layer 14. The etch separates the conductive layer 40 and the piezoelectric layer 20 into separate piezoelectric elements which will function as a capacitor dielectric for the piezoelectric transducers. Conductive layer 40 of FIG. 4 provides individual transducer top electrodes 40 of FIG. 5 while piezoelectric layer 20 provides the piezoelectric material for each transducer. Metal layer 14 can provide the bottom electrode for each transducer in the completed structure. Each transducer therefore can include a top electrode 40, dielectric 20, and bottom electrode 14.

Figure 6:
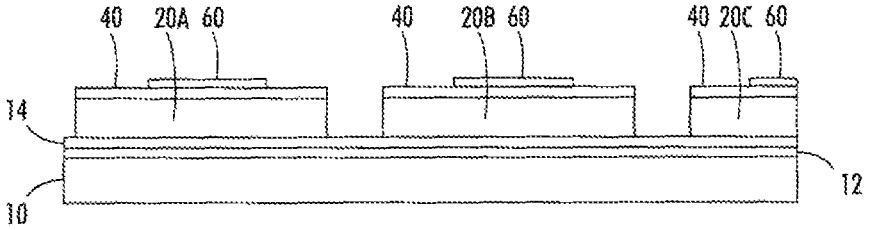

Subsequently, the patterned mask layer 42 can be removed and a patterned conductor layer (conductor) 60 can be formed on each transducer top electrode 40. The conductor 60 can include a plurality of conductive bumps, with one or more bumps on each transducer top electrode 40 as depicted in FIG. 6. The conductor 60 can be formed from a metal such as solder. In an embodiment, conductor 60 can be dispensed onto each transducer top electrode 40 as a conductive paste such as a silver-filled paste. The conductor 60 can be formed during this stage of processing, or before or after the current processing stage. FIG. 6 depicts cross sections of two complete piezoelectric elements 20A, 20B and one partial piezoelectric element 20C. Each transducer includes a bottom electrode 14, a piezoelectric element 20, and a top electrode 40. It will be understood that a transducer array can include a grid of several hundred transducers.

Figure 7:
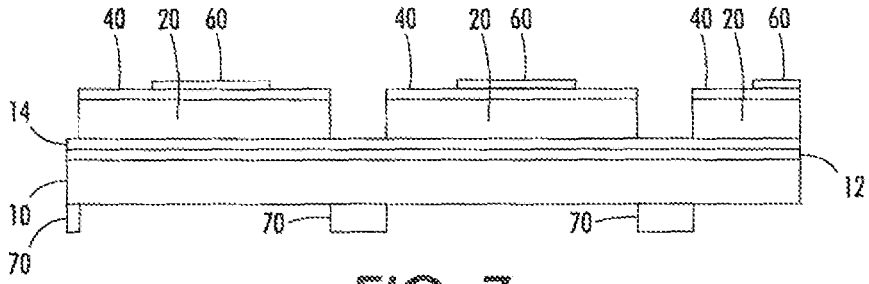

Next, a patterned mask 70 is formed over the semiconductor substrate 10 as depicted in FIG. 7, for example using optical photolithography of a photoresist layer or other suitable processes such as stenciling. The patterned mask 70 exposes the semiconductor substrate 10 at locations underlying the piezoelectric material 20 as depicted.

Figure 8:
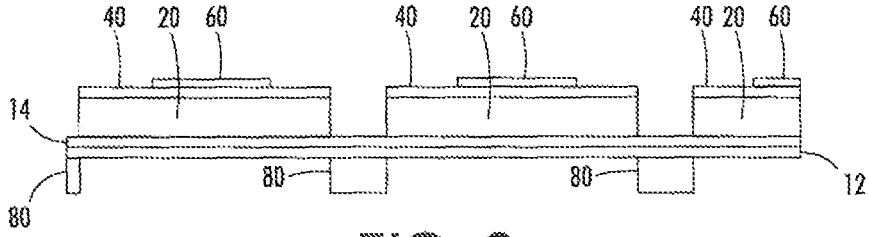

Subsequently, an etch of the semiconductor substrate 10 can be performed using mask 70 as a pattern. A chemical etch can be used to remove the material of the semiconductor substrate 10 (for example silicon) selective to the material of etch stop layer 12 (for example, silicon dioxide, silicon nitride, or boron doping of the substrate). In another embodiment, a timed etch can be used which can terminate after exposure of the etch stop layer 12. This etch patterns the semiconductor substrate 10 of FIG. 7 to provide a patterned jet stack body plate 80 as depicted in FIG. 8. After removal of the patterned mask 70, a structure similar to that depicted in FIG. 8 can remain.

Next, additional processing can be performed on the FIG. 8 structure, which can include the attachment of an inlet/outlet plate 90 to the body plate 80 using an adhesive 92. Further, an aperture plate 94 having a plurality of nozzles 96 can be attached to the inlet/outlet plate 90 using an adhesive 98 to result in a structure similar to that depicted in FIG. 9. The inlet/outlet plate 90 and the aperture plate 94 can be formed from stainless steel, or another suitable material.

Figure 9:
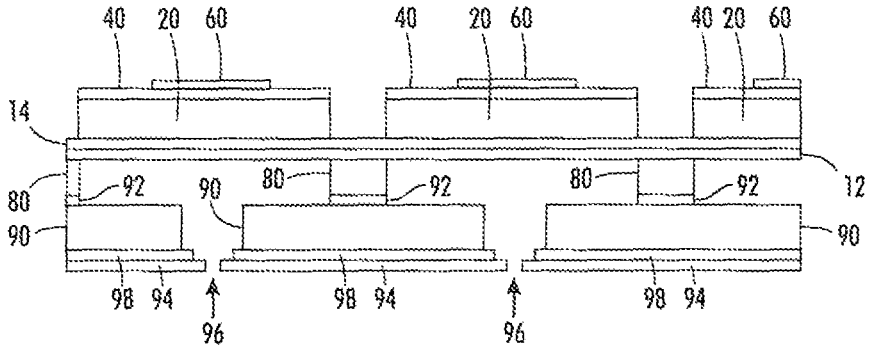
Figure 10:
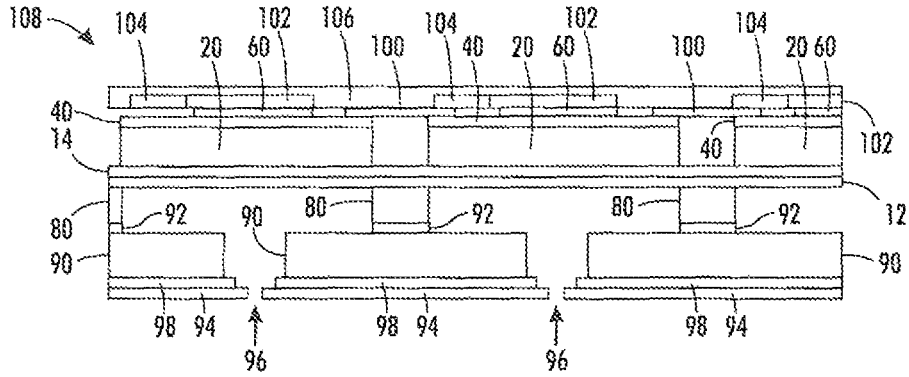

Next, a patterned standoff layer 100 can be attached to the top surface of the FIG. 9 structure as depicted in FIG. 10. The patterned standoff layer 100 can include one or more dielectric layers which, for example, have been stenciled using a laser to provide openings which expose the conductor 60 and the transducer top electrodes 40. A flex circuit including a plurality of conductive pads 102, conductive traces 104, and one or more dielectric layers 106 can be physically and conductively attached to the FIG. 9 structure as depicted in FIG. 10. The conductive pads 102 can be physically contacted with the conductor 60, then the conductor 60 can be heated and cooled (in the case of metal or solder conductive bumps) or cured using appropriate techniques (in the case of conductive paste) to electrically couple the plurality of flex circuit pads 102 to the plurality of transducer top electrodes 40 through the use of conductor 60. The plurality of transducers in the transducer array are thereby individually addressable through the traces 104 of the flex circuit. Any additional processing can be performed to complete the jet stack 108 as depicted in FIG. 10.

Figure 11:
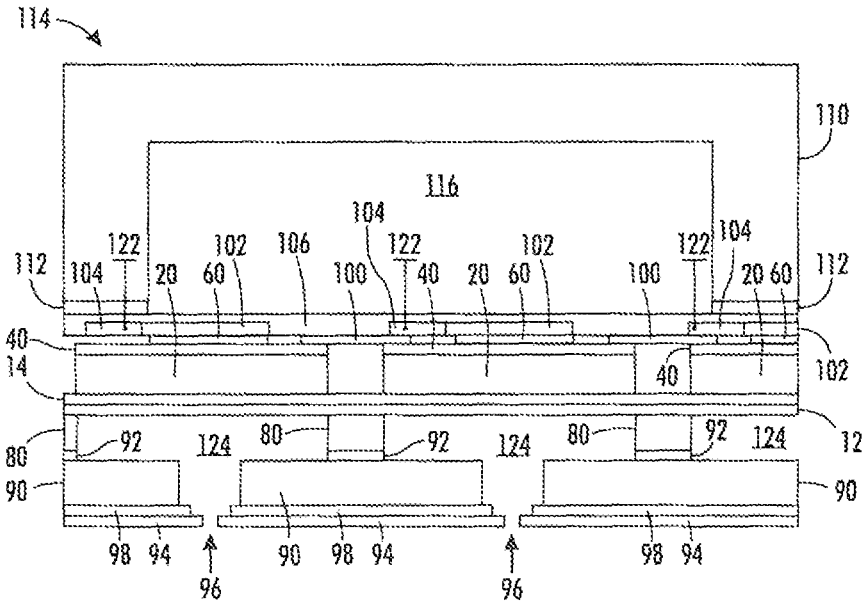

Next, a manifold 110 can be bonded to the upper surface of the jet stack 108, which physically attaches the manifold 110 to the jet stack 108. The attachment of the manifold 110 can include the use of a fluid-tight sealed connection 112 such as an adhesive to result in an ink jet print head 114 as depicted in FIG. 11. The ink jet print head 114 can include an ink reservoir 116 formed by a surface of the manifold 110 and the upper surface of the jet stack 108 for storing a volume of ink. Ink from the reservoir 116 is delivered through ports (not individually depicted) in the jet stack 108, wherein the ink ports are provided, in part, by a continuous opening through the flex circuit 106, the standoff layer 100, the diaphragm 14, and the etch stop layer 12. It will be understood that FIG. 11 is a simplified view. An actual print head may include various structures and differences not depicted in FIG. 11, for example additional structures to the left and right, which have not been depicted for simplicity of explanation.

In use, the reservoir 116 in the manifold 110 of the print head 114 includes a volume of ink. An initial priming of the print head can be employed to cause ink to flow from the reservoir 116, through the ink ports (not individually depicted) in the jet stack 108. Responsive to a voltage 122 placed on a trace 104 which is transferred to a pad 102 of the flex circuit pad array, to the conductor 60, to the piezoelectric electrodes top plate 40, each piezoelectric transducer bends or deflects at an appropriate time in response. The deflection of the transducer causes the diaphragm 14 to flex which creates a pressure pulse within a chamber 124 in the jet stack 108, causing a drop of ink to be expelled from the nozzle 96.

The methods and structure described above thereby form a jet stack 108 for an ink jet printer. In an embodiment, the jet stack 108 can be used as part of an ink jet print head 114 as depicted in FIG. 12.

Figure 12:
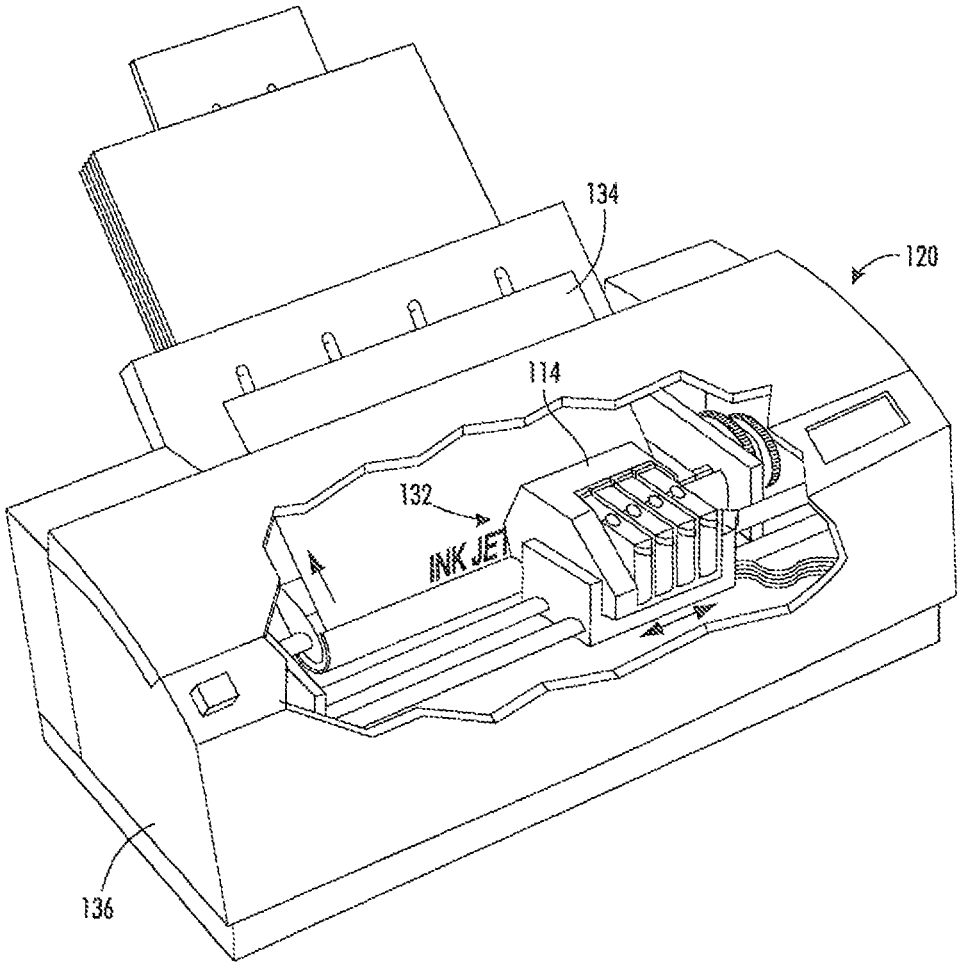
FIG. 12 is a perspective view of a printer including an ink jet print head according to an embodiment of the present teachings.

FIG. 12 depicts a printer 120 including one or more print heads 114 and ink 132 being ejected from one or more nozzles 96 in accordance with an embodiment of the present teachings. Each print head 114 is configured to operate in accordance with digital instructions to create a desired image on a print medium 134 such as a paper sheet, plastic, etc. Each print head 114 may move back and forth relative to the print medium 134 in a scanning motion to generate the printed image swath by swath. Alternately, the print head 114 may be held fixed and the print medium 134 moved relative to it, creating an image as wide as the print head 114 in a single pass. The print head 114 can be narrower than, or as wide as, the print medium 134. The printer hardware including the print head 114 can be enclosed in a printer housing 136. In another embodiment, the print head 114 can print to an intermediate surface such as a rotating drum or belt (not depicted for simplicity) for subsequent transfer to a print medium.

Figure 13:
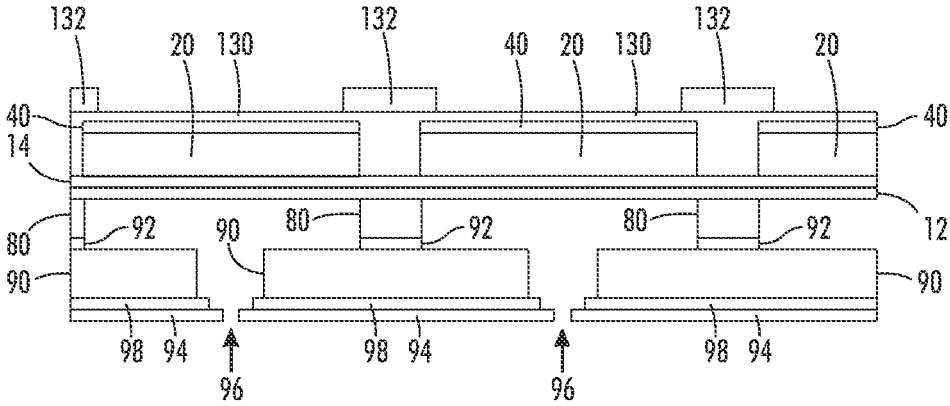
FIGS. 13-15 are cross sections.

Another embodiment of the present teachings is depicted in FIGS. 13-16. In this embodiment, some or all trace and/or pad metallization which is typically provided by a flex circuit or a PCB can be replaced using semiconductor device fabrication techniques. In an embodiment, a structure similar to that depicted in FIG. 9 can be formed, except that the conductor 60 is omitted. As depicted in FIG. 13, a planar dielectric interstitial layer 130 can deposited to provide a generally planar upper surface. The dielectric interstitial layer 130 can include, for example, a polyimide, a polymer, silicon dioxide, a photosensitive epoxy such as SU-8, benzocyclobutene (BCB), photoresist, etc. In this embodiment, the dielectric interstitial layer 130 can be formed to cover all device structures as depicted, including the piezoelectric transducer top electrodes 40. Also in this embodiment, the dielectric interstitial layer 130 is formed between adjacent transducers. Next, a patterned mask layer 132 is formed, for example using optical lithography to pattern a photoresist layer such that the patterned mask layer 132 includes openings which expose portions of each piezoelectric transducer top plate 40. Depending on the device design, the mask layer 132 can include other openings to expose other device structures to form other features, such as ink port openings (not individually depicted for simplicity) through the diaphragm 14 which allow the passage of ink during printing.

Figure 14:
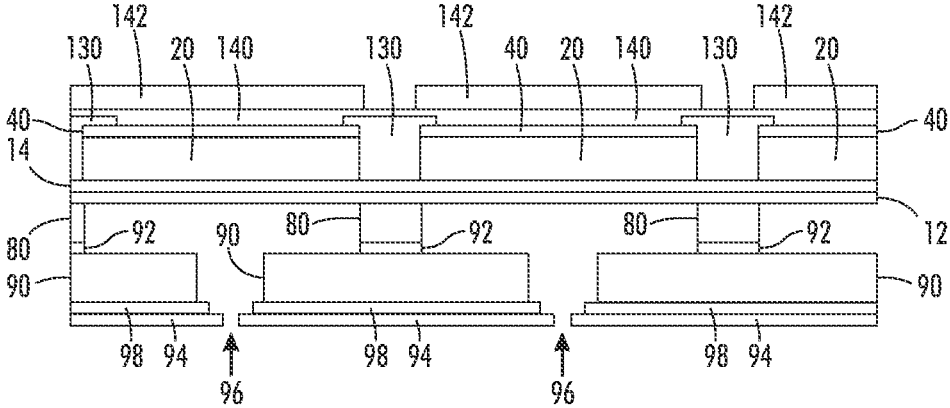

An etch is performed to remove the exposed dielectric interstitial layer 130, then the mask 132 is removed to result in the patterned dielectric interstitial layer 130 as depicted in FIG. 14. Next, a blanket metal layer 140 such as aluminum, copper, or an aluminum/copper stack is formed to contact the transducer top electrodes 40. FIG. 14 depicts the blanket metal layer 140 as being planar for simplicity, but it will be appreciated that the blanket metal layer 140 may be conformal. Subsequently, a patterned mask layer 142 is formed using, for example, optical photolithography to pattern a photoresist layer. The patterned mask layer 142 can be used to define contacts (i.e., pads) to the transducer top electrodes 40 as well as conductive traces to route a voltage to the contacts, and thus to the transducer top electrodes. Openings in the mask 142 at other locations can be used to clear any previously formed ports (not individually depicted for simplicity).

Figure 15:
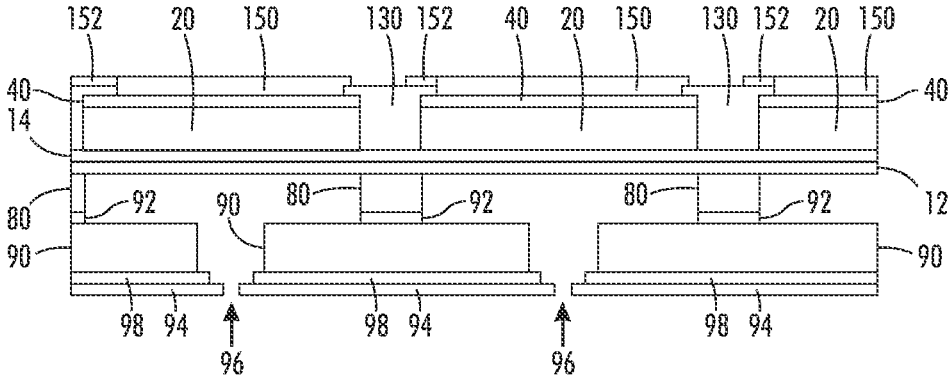

Next, an etch of the FIG. 14 structure is performed and the mask 142 is removed to result in the structure of FIG. 15, which depicts pads 150 and traces 152 formed from the metal layer 140.

Figure 16:
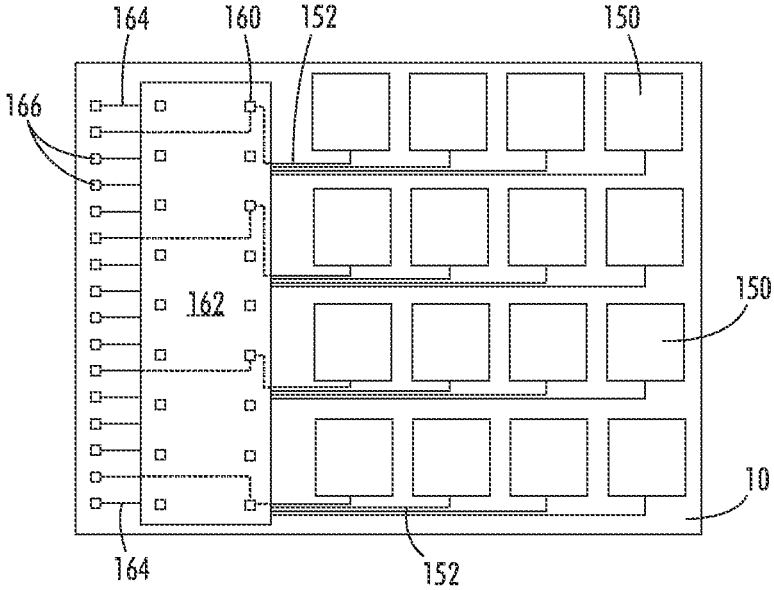
FIG. 16 is a plan view, depicting in-process structures for an ink jet print head according to another embodiment of the present teachings.

FIG. 16 is a plan view of the FIG. 15 structure, but depicts a larger area of the semiconductor substrate 10. The FIG. 16 structure includes a 4×4 array of transducers, but it will be appreciated that a grid can be formed which includes an array of more transducers, for example 1200 or more transducers. In FIG. 16, traces 152 can be electrically coupled with pads 150 at a first end of trace 152 and pads 160 at a second end of each trace. Each trace 152 thus can route a voltage between the pads 150 and pads 160 during operation of the device. The pads 160 at the second end of each trace 152 can underlie a semiconductor device such as an application specific integrated circuit (ASIC) 162, and thus would not be visible in the FIG. 16 structure but are depicted for explanation. The ASIC 162 can be flip-chip mounted over the semiconductor substrate 10 using, for example, a ball grid array (BGA) or bumped die to electrically couple landing pads (not depicted for simplicity) on the ASIC 162 to pads 160 on the second end of each trace 152. Additionally, traces or control lines 164 route signals between the pads 160 and pads 166, which can be located along an edge of the substrate 10. In turn, pads 166 can be connected to a flex circuit (not depicted for simplicity) and routed to a driver board (not depicted for simplicity). Each transducer is thus individually addressable by the driver board and/or the ASIC 162 using the plurality of traces 152 and the plurality of pads 150. As discussed above, each pad 150 is electrically coupled with a transducer top electrode 40. The ASIC 162 can include additional landing pads to receive additional operating signals from the driver board, and can provide other functionality such as logic and control functions.

The embodiment of FIGS. 13-16 can be used to form very small pads 150, 160, 166, very narrow traces 152, 164, and a high resolution print head. The formation of very small features is enabled through the use of semiconductor device processing techniques, for example photolithography, metallization such as sputtering and CVD, and etching techniques to form an integrated device. In this embodiment, input/output functions can be performed through control lines 164 to the ASIC 162. The number of control lines 164 can be much less than the lead count of the output 152 from the transducer array. An ASIC 162 can be accessed through a lead count of 20 or 24, while the lead count from the transducer array is equal to or about equal to the number of transducers. Additionally, traces formed using conventional methods can have a pitch of about 38 μm, while traces formed using lithography can have a pitch of about 3 μm, depending on device topography as well as other factors.

Further, by eliminating adhesives and their bonding/curing operations, a yield improvement can be realized. Delamination of these structures is reduced or eliminated. Further, because clean room processing has reduced contamination over conventional print head processing, failure modes such as nozzle blocking can be reduced. Further, failures related to temperature cycling are expected to be less using the fabrication techniques discussed herein compared to print heads produced using conventional techniques.

The advantages of this approach over existing methods include the potential for very small feature sizes. The elimination of components, materials and assembly stages can simplify manufacturing by leveraging the ability to outsource the silicon processing to any one of a number of contract (foundry) semiconductor wafer fabrication facilities. Additional benefits include increased resolution allowing for even higher densities, and improved cleanliness by eliminating laser cut parts. Yields can improve through elimination of many current failure modes such as PZT delamination, and ink leaks between chambers. Printhead uniformity can be improved by highly repeatable semiconductor manufacturing processes, potentially allowing for the elimination of print head normalization. Additionally, by simplifying the material set, compatibility with ink and other environmental materials typical of ink jet print heads can be improved.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A print head jet stack comprising a plurality of transducers, wherein the print head jet stack comprises:

a semiconductor substrate body plate;

a diaphragm overlying the semiconductor substrate body plate;

a patterned piezoelectric layer overlying the diaphragm;

a first patterned conductive layer overlying the patterned piezoelectric layer, wherein the diaphragm comprises a conductive bottom electrode of the plurality of transducers, the patterned piezoelectric layer comprises a plurality of piezoelectric elements for the plurality of transducers, wherein each piezoelectric element is separated from an adjacent piezoelectric element by a space, and the first patterned conductive layer comprises a plurality of top electrodes for the plurality of transducers;

a dielectric interstitial layer interposed directly between adjacent transducers of the plurality of transducers, wherein the dielectric interstitial layer physically contacts the diaphragm and the patterned piezoelectric layer, fills the space between each adjacent piezoelectric element from the diaphragm to an upper surface of the first patterned conductive layer, comprises a planar upper surface, and overlies a portion of the first patterned conductive layer;

a second patterned conductive layer that physically contacts the planar upper surface of the dielectric interstitial layer, wherein a portion of the dielectric interstitial layer is directly interposed between the first patterned conductive layer and the second patterned conductive layer in a direction perpendicular to the diaphragm, the second patterned conductive layer comprising:

a plurality of first pads that overlie and physically and electrically contact the plurality of top electrodes, and physically contact the planar upper surface of the interstitial dielectric layer;

a plurality of traces electrically coupled to the plurality of first pads that physically contact the planar upper surface of the interstitial dielectric layer;

a plurality of second pads electrically coupled to the plurality of traces and to the plurality of first pads, wherein the plurality of second pads are each laterally located with respect to the patterned piezoelectric layer; and an application specific integrated circuit (ASIC) electrically coupled to each of the plurality of second pads.

2. The print head jet stack of claim 1, wherein the semiconductor substrate body plate comprises an etched semiconductor wafer section.

3. The print head jet stack of claim 1, wherein the diaphragm is at least one of a chemical vapor deposition (CVD) metal and a sputtered metal.

4. The print head jet stack of claim 1, further comprising:

an etch stop layer interposed between the diaphragm and the semiconductor substrate body plate.

5. The print head jet stack of claim 1, wherein the first conductive layer and the second conductive layer are each one of a chemical vapor deposition (CVD) metal and a sputtered metal.

6. The print head jet stack of claim 5, further comprising:

an application specific integrated circuit (ASIC) flip-chip mounted to the semiconductor substrate and to the plurality of second pads, and electrically coupled with the plurality of top electrodes for the plurality of transducers through the plurality of second pads.

7. A printer, comprising:

a print head comprising a print head jet stack, the print head jet stack comprising:

a plurality of transducers;

a semiconductor substrate body plate;

a diaphragm overlying the semiconductor substrate body plate;

a patterned piezoelectric layer overlying the diaphragm;

a first patterned conductive layer overlying the patterned piezoelectric layer, wherein the diaphragm comprises a conductive bottom electrode of the plurality of transducers, the patterned piezoelectric layer comprises a plurality of piezoelectric elements for the plurality of transducers, wherein each piezoelectric element is separated from an adjacent piezoelectric element by a space, and the first patterned conductive layer comprises a plurality of top electrodes for the plurality of transducers;

a dielectric interstitial layer comprising a material selected from the group consisting of polyimide, polymer, silicon dioxide, photosensitive epoxy, and photoresist interposed directly between adjacent transducers of the plurality of transducers, wherein the dielectric interstitial layer physically contacts the diaphragm and the patterned piezoelectric layer, fills the space between each adjacent piezoelectric element from the diaphragm to an upper surface of the first patterned conductive layer, comprises a planar upper surface, and overlies a portion of the first patterned conductive layer;

a second patterned conductive that layer physically contacts the planar upper surface of the dielectric interstitial layer, wherein a portion of the dielectric interstitial layer is directly interposed between the first patterned conductive layer and the second patterned conductive layer in a direction perpendicular to the diaphragm, the second patterned conductive layer comprising:

a plurality of first pads that overlie and physically and electrically contact the plurality of top electrodes, and physically contact the planar upper surface of the interstitial dielectric layer;

a plurality of traces electrically coupled to the plurality of first pads that physically contact the planar upper surface of the interstitial dielectric layer; and a plurality of second pads electrically coupled to the plurality of traces and to the plurality of first pads, wherein the plurality of second pads are each laterally located with respect to the patterned piezoelectric layer;

an application specific integrated circuit (ASIC) electrically coupled to each of the plurality of second pads; and a printer housing which encloses the print head.

8. The printer of claim 7, wherein the semiconductor substrate body plate comprises an etched semiconductor wafer section.

9. The printer of claim 7, wherein the diaphragm is at least one of a chemical vapor deposition (CVD) metal and a sputtered metal.

10. The printer of claim 7, wherein the print head jet stack further comprises:

an etch stop layer interposed between the diaphragm and the semiconductor substrate body plate.

11. The printer of claim 7, wherein the first conductive layer and the second conductive layer are each one of a chemical vapor deposition (CVD) metal and a sputtered metal.

12. The printer of claim 11, further comprising:

an application specific integrated circuit (ASIC) flip-chip mounted to the semiconductor substrate and to the plurality of second pads, and electrically coupled with the plurality of top electrodes for the plurality of transducers through the plurality of second pads.

13. The print head jet stack of claim 1, wherein the dielectric interstitial layer comprises a material selected from the group consisting of polyimide, polymer, silicon dioxide, photosensitive epoxy, and photoresist.

* * * * *